US009730489B2

(12) United States Patent
Park

(10) Patent No.: US 9,730,489 B2
(45) Date of Patent: Aug. 15, 2017

(54) HIGH HEEL FOR EXERCISING ACHILLES TENDONS WHILE WALKING

(71) Applicant: Young-Soul Park, Seoul (KR)

(72) Inventor: Young-Soul Park, Seoul (KR)

( * ) Notice: Subject to any disclaimer, the term of this patent is extended or adjusted under 35 U.S.C. 154(b) by 0 days.

(21) Appl. No.: 14/691,139

(22) Filed: Apr. 20, 2015

(65) Prior Publication Data

US 2015/0223566 A1 Aug. 13, 2015

Related U.S. Application Data

(63) Continuation of application No. PCT/KR2013/009341, filed on Oct. 18, 2013.

(30) Foreign Application Priority Data

Oct. 19, 2012 (KR) ..... 10-2012-0116943

(51) Int. Cl.
*A43B 21/00* (2006.01)
*A43B 13/18* (2006.01)
(Continued)

(52) U.S. Cl.
CPC ..... *A43B 21/00* (2013.01); *A43B 13/184* (2013.01); *A43B 13/206* (2013.01); *A43B 21/24* (2013.01)

(58) Field of Classification Search
CPC ... A43B 17/006; A43B 7/1445; A43B 7/1425; A43B 13/186; A43B 13/184;
(Continued)

(56) References Cited

U.S. PATENT DOCUMENTS 1,152,557 A * 9/1915 Scholl ..... A43B 7/38 36/81
2,194,637 A * 3/1940 Burger ..... A43B 17/00 36/19.5
(Continued)

FOREIGN PATENT DOCUMENTS

JP 2001-029107 A 2/2001
JP 2001-137003 A 5/2001
(Continued)

OTHER PUBLICATIONS

English Translation, JP 3135875, Jun. 2007, Japan, Hiroshi Kitamura, Paragraph 27.*

*Primary Examiner* — Sally Haden
*Assistant Examiner* — Jillian K Pierorazio
(74) *Attorney, Agent, or Firm* — Jefferson IP Law, LLP

(57) ABSTRACT

The present invention relates to a high heel for women, and particularly, to a high heel which not only prevents weight from being concentrated to the toe when worn but also absorbs shock to achieve walking comfort, and in which stress is provided to the arch of the sole to prevent deformation of the toes and exercise the Achilles' tendon such that joints are protected and the posture is corrected thereby preventing damage to the spine. To this end, a protrusion part 1 is formed at a part to support a back end of the arching of the sole, and an inclined surface 2 inclined downward from a back end of the protrusion part 1, which positions the heel of the sole to an end part of the high heel such that the Achilles' tendon can be exercised while walking.

2 Claims, 5 Drawing Sheets

(51) Int. Cl.
*A43B 21/24* (2006.01)
*A43B 13/20* (2006.01)

(58) Field of Classification Search
CPC ..... A43B 13/12; A43B 5/12; A43B 13/146; A43B 13/10; A43B 3/128; A43B 21/00; A43B 21/24
USPC ..... D2/965, 925, 922; 36/34 R, 145, 180, 36/182
See application file for complete search history.

(56) References Cited

U.S. PATENT DOCUMENTS 2,221,202 A * 11/1940 Ratcliff ..... A43B 7/14 36/155
4,250,886 A * 2/1981 Riso ..... A43B 7/14 36/180
4,631,841 A * 12/1986 Hickey ..... A43B 7/1415 36/145
4,835,884 A * 6/1989 Bianchini ..... A43B 13/28 36/108
5,373,650 A * 12/1994 Dananberg ..... A43B 7/14 36/172
5,435,077 A * 7/1995 Pyle ..... A43B 13/00 36/28
5,699,627 A * 12/1997 Castro ..... A43B 1/0045 36/28
5,732,481 A * 3/1998 Farhad ..... A43B 7/14 36/37
5,782,015 A * 7/1998 Dananberg ..... A43B 7/141 36/34 R
7,322,132 B2 * 1/2008 Dananberg ..... A43B 7/14 36/174
7,367,074 B1 * 5/2008 Bergquist ..... A43B 7/28 12/142 N
8,490,297 B2 * 7/2013 Guerra ..... A43B 7/1425 36/28
2003/0226283 A1 * 12/2003 Braunschweiler ..... A43B 3/24 36/29
2004/0211086 A1 * 10/2004 Dananberg ..... A43B 7/14 36/11.5
2006/0174512 A1 * 8/2006 LaDuca ..... A43B 5/12 36/8.3
2008/0072462 A1 * 3/2008 Fusco ..... A43B 5/00 36/25 R
2008/0086906 A1 * 4/2008 Wilkenfeld ..... A43B 5/12 36/8.3
2008/0209766 A1 * 9/2008 Braunschweiler ... A43B 13/184 36/102
2008/0289224 A1 * 11/2008 Sink ..... A43B 13/145 36/103
2009/0007455 A1 * 1/2009 Montgomery ..... A43B 7/1445 36/91
2012/0297641 A1 * 11/2012 Pfister ..... A43B 7/223 36/43
2012/0324758 A1 * 12/2012 Tang ..... A43B 13/12 36/28
2014/0298680 A1 * 10/2014 Oloff ..... A43B 7/142 36/28

FOREIGN PATENT DOCUMENTS

JP 3135875 * 6/2007 ..... A43B 13/42
JP 3135875 9/2007
KR 2000-0048825 A 7/2000

* cited by examiner

[Fig. 1]
[RELATED ART]
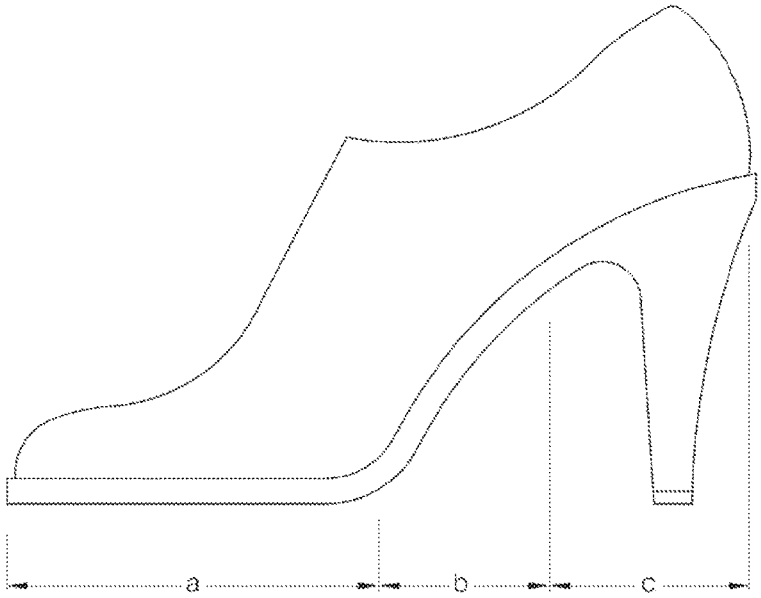

[Fig. 2]
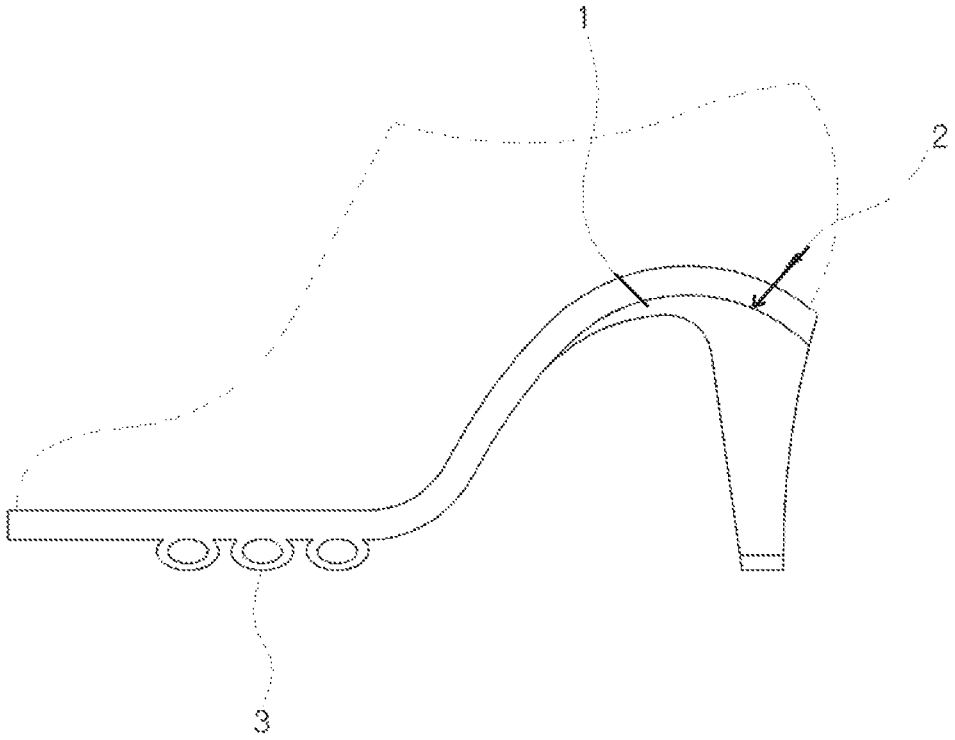

[Fig. 3]
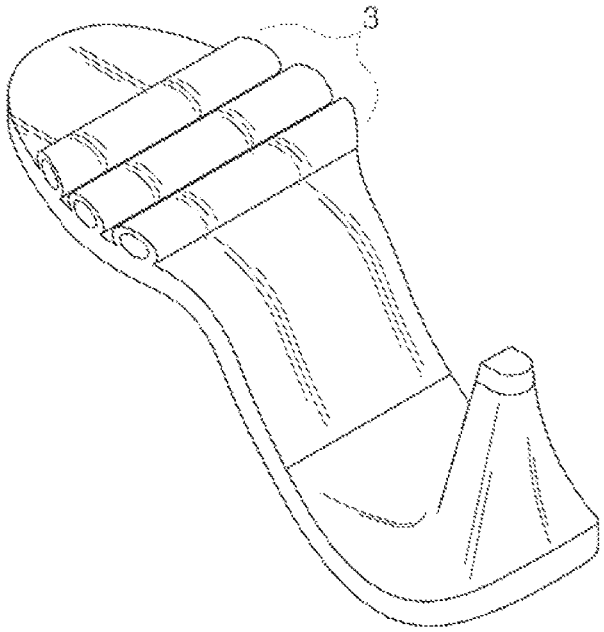
[Fig. 4]
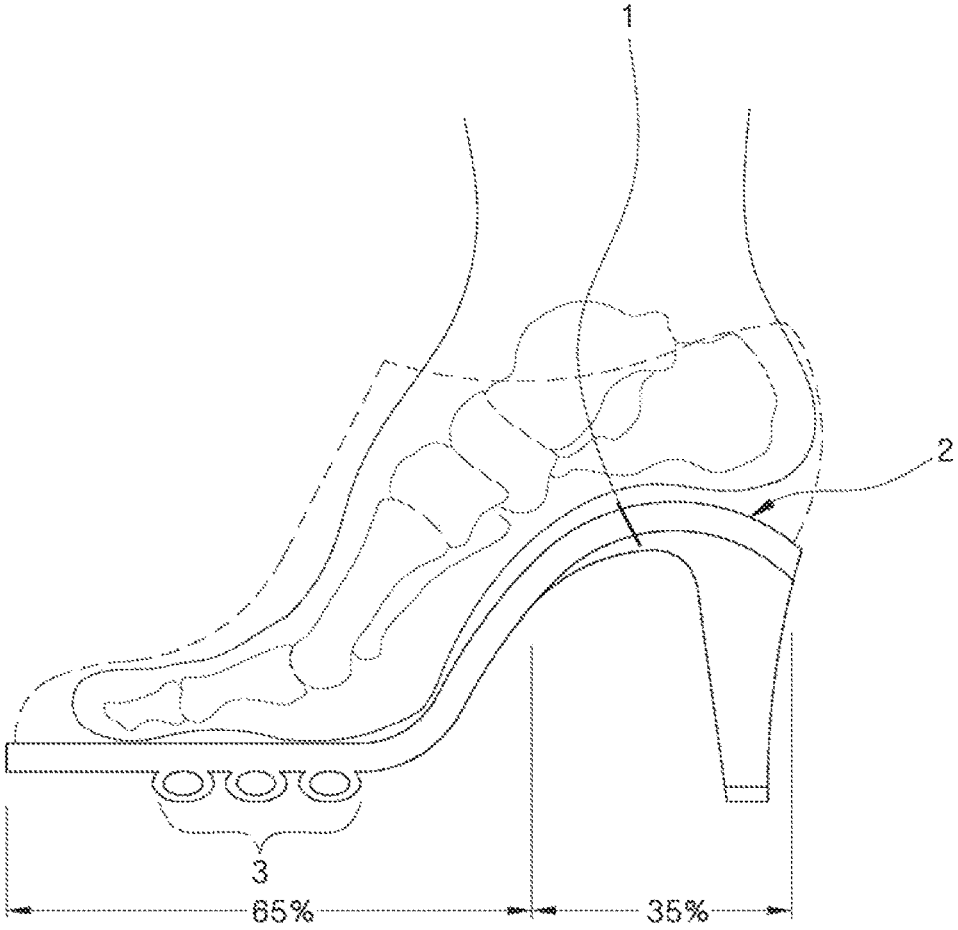

[Fig. 5]
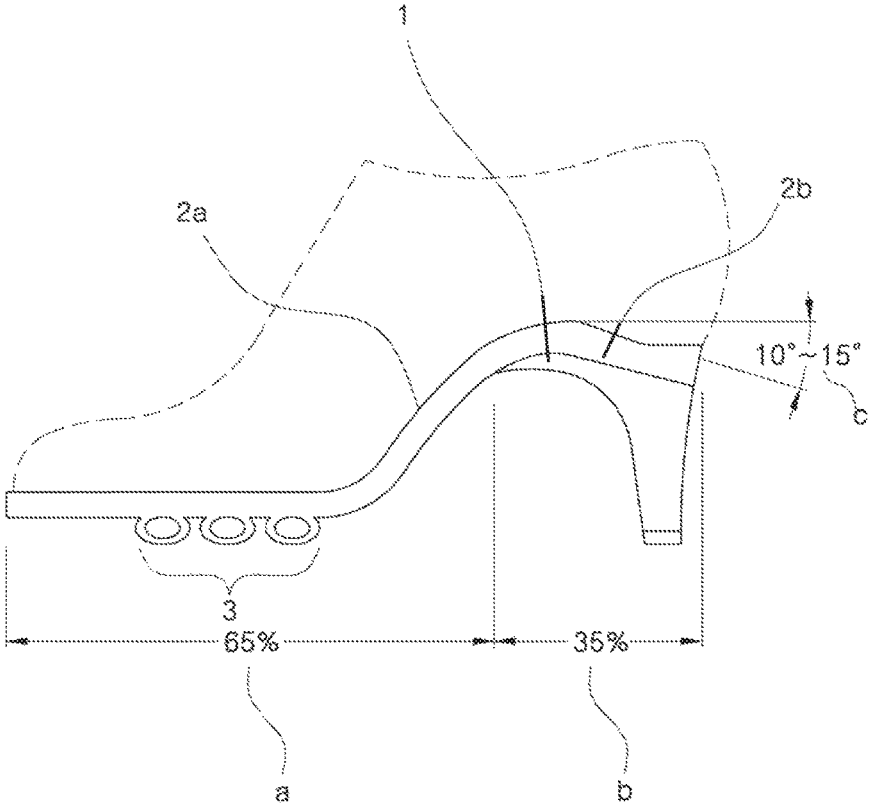
[Fig. 6]
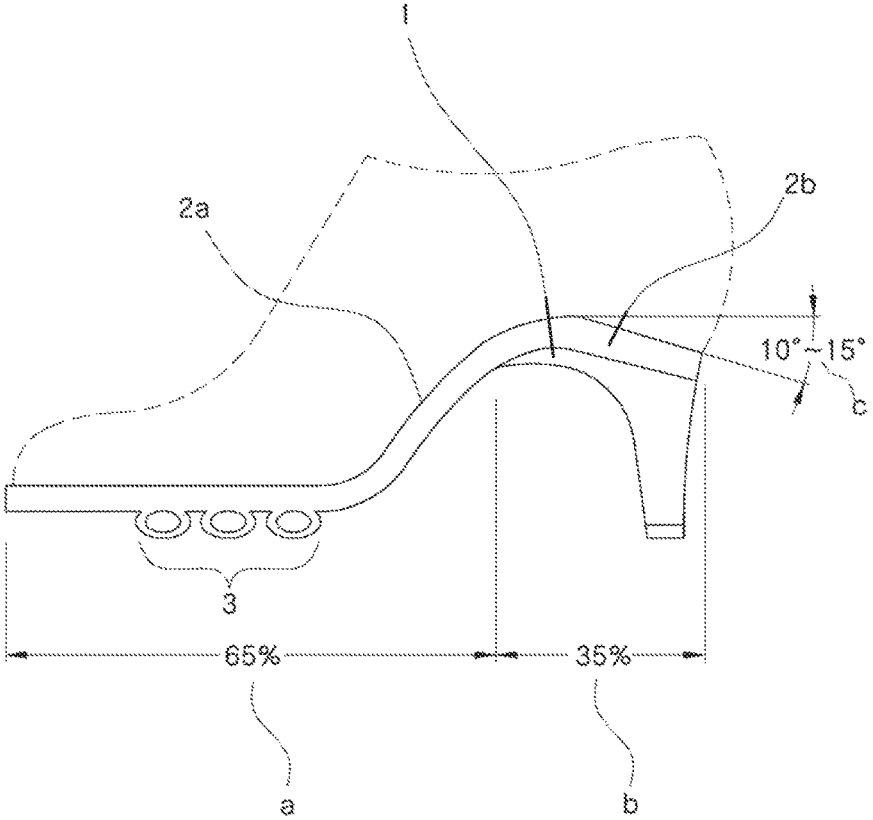

[Fig. 7]
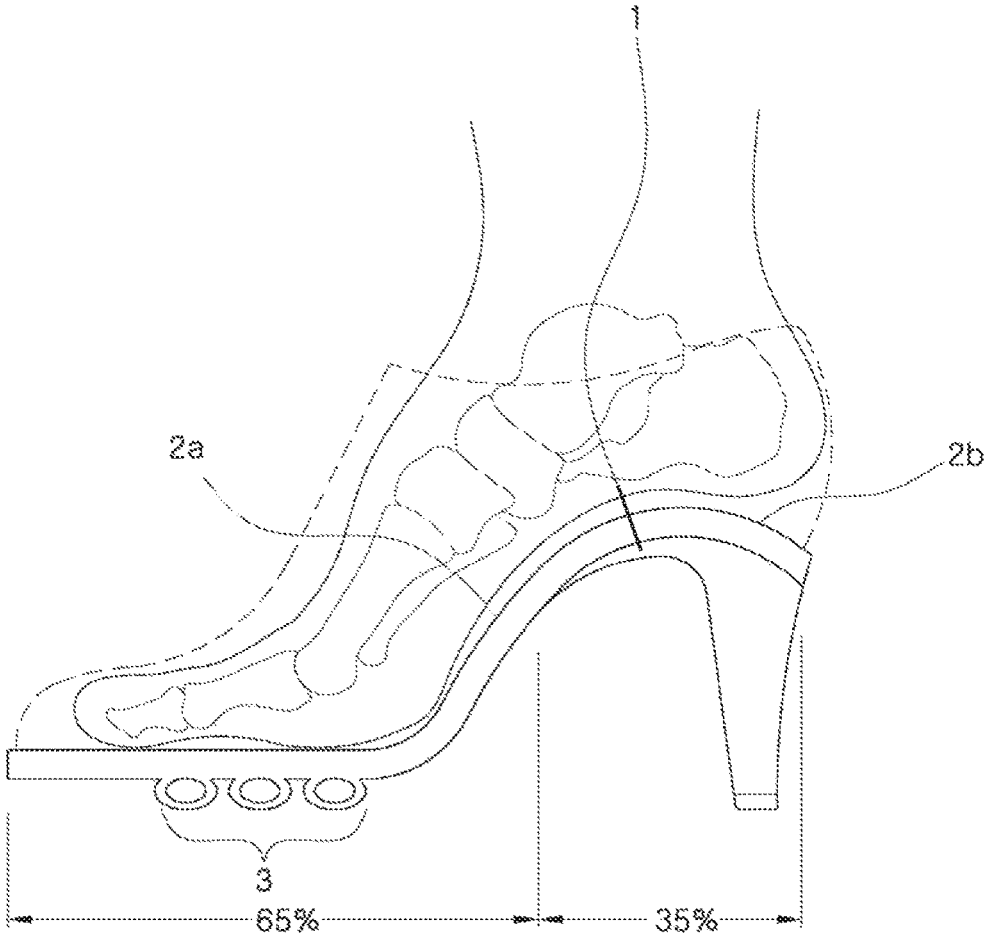

HIGH HEEL FOR EXERCISING ACHILLES TENDONS WHILE WALKING

CROSS-REFERENCE TO RELATED APPLICATION(S)

This application is a continuation application, claiming the benefit under §365(c), of an international application serial number PCT/KR2013/009341, filed on Oct. 19, 2013, which claimed the benefit of a Korean patent application filed on Oct. 19, 2012 in the Korean Intellectual Property Office and assigned Serial number 10-2012-0116943, the entire disclosure of each of which is hereby incorporated by reference.

TECHNICAL FIELD

The present invention relates to a high heel for women, and particularly, to a high heel which not only prevents weight from being concentrated to the toe when worn but also absorbs shock to achieve walking comfort, and in which stress is provided to the arch of the sole to prevent deformation of the toes and exercise the Achilles' tendon such that joints are protected and the posture is corrected thereby preventing damage to the spine.

BACKGROUND

Currently, high heels are an indispensable fashion item for women, and high heels provide visual effects of making legs of women look longer and charms of emphasizing femininity thereby attracting hearts of many women.

Therefore, taking these points into consideration, heels of recent high heels are becoming higher to a height beyond imagination such that even models who are professional walkers fall down at fashion shows, however many women are not aware of the dangers from high heels.

Currently, according to public knowledge, many factors that harm the health of feet, the health of joints and the health of spine exist hidden behind the popularity of the high heels.

First, when walking for a long period of time while wearing the high heel having a high heel part, the ankle becomes unstable and excessive pressures occur at forefoot, and knee joints (knees) may be stressed because ankles are unstable.

In other words, because the heel is high, the ankle moves left and right while walking, muscles and joints continuously perform their role to maintain balance thus receiving large amounts of stress, and the joints become damaged when the walking is extended for a long period of time.

Second, the heel of the high heel is high and most of parts enclosing the forefoot part including the toes of the foot, in other words, a front nose is narrowly formed to provide a sense of beauty, so when the center of gravity becomes concentrated at a front part while walking, due to the pressure by the weight of the person walking and also the walking pressure concentrating to the foot front part (front part of the foot), a large amount of pressure is transferred to the forefoot of the toe.

Therefore, because the pressure concentrates to a specific part, blisters, calluses or corns may form at the forefoot part, and as a result, the concentration to the front part of the foot eventually causes pain from the big toe bending toward the second toe and a bone protruding outward due to hallux valgus of the toe.

In other words, the excessive pressure to the front part of the foot and the reduced area of the front part of the high heel eventually reduces the stress transferred to an inner arch of the sole, so, because the front part is narrow, the toes become bent when wearing the shoe.

In addition, if the stress is not continuously transferred to the inner arch, the toe is continuously bent.

Third, when the center of gravity moves to the front of the body due to the height of the high heel, the spine becomes deformed and the deformation is called lordosis, and when the deformation is extended for a long period of time, various spinal disorders such as low back pain, lumbar herniated intervertebral disc, etc. may occur, and as a result, pain in the shoulder and the neck may occur.

Therefore, experts advise that to prevent the occurrences, the muscles which are shortened due to the deformation should be stretched and strengthened, and the high heel should not be worn for a long period of time.

Fourth, recent research states that due to the height of the high heel, the pressure applied to the knee increases about 25% more than when the high heel is not worn, so the high heel does not only endanger the foot, but also our knee.

In addition, because of the height of the high heel, the gait becomes unstable, and the possibility of pain due to an ankle sprain is high while walking on an uneven surface.

Further, due to the height of the high heel, a contraction of the muscle may occur, so pain in the heel of the foot may occur and other joints may become degraded.

In other words, the body should be balanced by the entire foot to walk correctly, however, because the weight concentrates to the front since the heel is lifted while walking with the high heel, the body leans forward, so the pelvis and the neck naturally moves out to the front thus a normal spinal position cannot be established.

In addition, the muscles are contracted for a long period of time when the high heel is worn, and as a result, when a calf muscle, which is the most important factor for walking, is contracted, a normal blood circulation becomes difficult so symptoms of varicose veins may occur.

Further, because the center of gravity concentrates to one side of the body, calluses or corns at the big toe may occur and the legs may become deformed into an O shape due to an ankle deformation.

In addition, when the high heel is worn, the heel is lifted so the length of the gastrocnemius (calf muscle) becomes shorter, and the length of the Achilles' tendon, which connects the gastrocnemius, also becomes significantly shorter.

In addition, to block the body from leaning, the waist leans backward and the length of an elector spine muscle becomes shorter (lordosis: risk of a disk).

Further, because the waist leans backward, the lower abdomen sticks out and the abdominal muscle becomes stretched and the strength in the abdominal part reduces.

In addition, the waist is in constant pain since muscle cramps (length is shortened) in the waist occur, the risk of disk exist, the strength of the abdominal part becomes weaker so the abdominal part sticks out and a sense of having a potbelly may be felt even when standing still.

Further, the high heel weakens the Achilles' tendon. The Achilles' tendon is a tendon attached to the heel bone, and is anatomically called a calcaneal tendon. The triceps muscle of the calf, which forms the calf of a back surface of the lower leg, is formed by gastrocnemius and soleus muscles, the lower part of the musculus bicep is formed by the rotator cuff, and these are combined to form a strong joint tendon to form the Achilles' tendon.

In other words, when taking a step or running, the triceps muscles of the calf contract and the Achilles' tendon become very tense. This is the Achilles' tendon or anatomically called the calcaneal tendon.

The muscles forming the calf of a back surface of the lower leg are the triceps muscles of the calf, which are formed by the gastrocnemius muscle having two convex heads and the soleus muscle having one convex head at a deep part of the gastrocnemius muscle.

The lower part of the musculus bicep is formed by the rotator cuff, and these are combined to form a strong joint tendon. This is the Achilles' tendon. The lower part of this muscle is attached to an elevated back surface of the calcaneus (heel bone) such that the muscle may be touched through the skin just above the heel. When the triceps muscles of the calf contract, the heel is pulled along with this muscle so the foot bends toward the sole. When a part at which the Achilles' tendon exist is hit while the foot is maintained vertical to a lower leg axis, the triceps muscles of the calf contract by the stimulation, the foot reflexively bends toward the sole.

This is called the Achilles' tendon reflex. The nucleus of the reflex is in the sacral part of the spinal cord, the reflex does not occur when this part is damaged. Therefore, the loss of the Achilles' tendon reflex is helpful for diagnosing diseases of the spinal cord or the spinal nerves. When taking a step or running, the triceps muscles of the calf contract and the Achilles' tendon become very tense. In this case, when a sudden motional force is applied to an unnatural direction, the possibility of the tendon being torn is high. In this case, the tendon detaches from the attaching part of the calcaneus or the tendon becomes cracked (Achilles' tendon rupture).

Recently, when women who enjoy wearing the high heels wear sneakers or a shoe having a low heel, pain occurs in the heel, and this is due to the Achilles' tendinitis occurring from the Achilles' tendon contracting by wearing the high heel for a long period of time.

In other words, the Achilles' tendinitis occurs by the contracted Achilles' tendon stretching in the heel of the foot and the calf muscle when the sneaker is worn, and when the level of the contraction is high, pain from a significant pull may be felt.

The reason is that, because of the high heel, the Achilles' tendon becomes thick and hard such that the Achilles' tendon becomes inelastic, and when an exercise is started, the Achilles' tendon becomes strained and inflamed.

Currently, according to public knowledge, about 70% to 80% of 500 adult women in the ages of 20 to 30 who wear high heels say that they definitely wear the high heels two to three times every week, at least 40% to 50% of these women wear high heels having 7 cm or higher, and 50% of these women wear the high heels for at least 5 hours a day.

In addition, at least 50% to 60% of the women who wear high heels experienced deformation of the foot, 30% to 40% experienced bending of the toe, and about 10% experienced bending of the top side of the foot or the heel protruding outward.

Specifically, the public knowledge shows an unexpected result of one out of three women who enjoy wearing the high heels at least two to three times a week (29.7%, 115 persons/387 persons) felt more comfortable when wearing the high heels which are the cause of the foot disorders than when wearing low shoes such as sneakers.

A group preferring shoes of at least 7 cm among the group who answered that the high heels are more comfortable is 56.5% (65 persons/155 persons), which is 15% higher than a group who answered that the high heels are uncomfortable 41.2% (112 persons/272 persons). A group wearing the high heels every day among the group who answered that the high heels are more comfortable is 13% (15 persons/155 persons), which is close to 3 times more than the group who answered that the high heels are uncomfortable 5% (14 persons/272 persons).

Therefore, when the heel of the shoe is high, the heel of the wearer is always lifted and causes abnormal deformation.

In other words, when the high heel is frequently worn, the heel of the wearer is always fixed at the lifted state, so the foot adapts to the shape of the high heel. Specifically, the length of the back part the Achilles' tendon, in which the elasticity is degraded in accordance with the height of the high heel, becomes suddenly stretched when the high heel is removed, thus a pull is felt in the heel of the wearer such that pain occurs. Thus, wearing a shoe without heels or standing barefoot becomes uncomfortable.

Therefore, when the high heel is continuously worn, the elasticity degrades due to the abnormal deformation of the Achilles' tendon, which is a muscle strongly functioning when the heel of the wearer is lifted, so when the wearer moves while wearing the low shoe, the hardened Achilles' tendon suddenly stretches and receives a large amount of stress.

In addition, when the high heel is worn for a long period of time, the flexibility of the muscular fiber of the calf muscle degrades and does not correctly absorb the shock from making contact with the ground. In this case, the possibility of a small rupture occurring to the Achilles' tendon or the Achilles' tendinitis, in which inflammation to the aponeurosis covering the Achilles' tendon occurs, occurring becomes higher.

DISCLOSURE

Therefore, in the present invention, the pressure concentrating to the front part of the foot is dispersed and the Achilles' tendon is repetitively stretched while walking, so the Achilles' tendon is exercised and a pressure is repetitively applied to the inner arch of the sole, such that the sole is prevented from deformation, the ankle and knee joints are protected while walking and the spine is prevented from deformation.

Technical Solution

To this end, the heel part of the high heel is classified into a front end inclined surface, a middle end supporting surface, and a back end inclined surface, and a protruding part protrudes at a boundary of the front end inclined surface and the middle end supporting surface such that the protruding part makes close contact with an inner arch, and the flat middle end supporting surface and the back end inclined surface allows the Achilles' tendon of a heel part of a foot to stretch when the heel part of the foot lands while walking.

Advantageous Effects

Therefore, the heel part of the high heel is classified into a front end, a middle end, and a back end, and an inclined angle of the front end to the middle end and an inclined angle of the middle end to the back end are made different such that a pressure is applied to an inner arch of a sole each time a step is taken, an Achilles' tendon of a heel part of a foot is repetitively stretched when the foot lands on the ground to start the step by the inclined angle from the middle end to the back end, and a pressure is prevented from being concentrated to a front part of the foot since protruding parts of the front end and the middle end are latched by the inner arch of the sole.

BRIEF DESCRIPTION OF THE DRAWINGS

FIG. 1 is a perspective view showing a typical high heel according to an embodiment.

FIG. 2 is a perspective view showing a heel part of a high heel according to an embodiment of the present invention.

FIG. 3 is a perspective view showing a floor surface of FIG. 2.

FIG. 4 is a view showing a state of a foot wearing the high heel according to an embodiment of the present invention.

FIG. 5 is another view showing the heel part of the floor surface of the high heel according to an embodiment of the present invention.

FIG. 6 is view showing a state of a foot wearing the high heel of FIG. 5.

FIG. 7 is a view showing a state in which an Achilles' tendon is pulled while walking when the high heel is worn according to an embodiment of the present invention.

BEST MODE

A high heel for exercising an Achilles' tendon while walking according to an exemplary embodiment of the present invention, which is classified into a part a to support a toe positioned at a front end of a sole as the toe is bent to a joint part with the sole at a predetermined angle, a part b to support an arching part of the sole positioned at a back end of the part a, and a part c closely making contact with a heel of the sole positioned at a back end of the part b. The high heel includes: a protrusion part 1 formed at a part to support a back end part of the arching part of the sole; and an inclined surface 2 inclined downward from a back end of the protrusion part, which positions the heel of the sole to an end part of the high heel.

MODE FOR INVENTION

Hereinafter, exemplary embodiments of the present invention are described in detail with reference to the accompanying drawings.

First, when the high heel is worn, the high heel is classified into a part a to support a toe positioned at a front end of a sole as the toe is bent to a joint part with the sole at a predetermined angle, a part b to support an arching part of the sole positioned at a back end of the part a, and a part c closely making contact with a heel of the sole positioned at a back end of the part b. In the present invention, as shown in FIGS. 2 to 4, the high heel includes: a protrusion part 1 formed at a part to support back end part of the arching part of the sole; and an inclined surface 2 inclined downward from a back end of the protrusion part, which is a part to position the heel of the sole to an end part of the high heel.

In this case, the protrusion part 1 is positioned on the beginning part of the heel of the arching part of the sole. In addition, the inclined surface 2 inclined down downward includes a curved surface curved upward, and the beginning point of the inclined surface is positioned at which the Achilles' tendon is pulled when the foot is landed to start walking.

Therefore, when the foot is landed to start walking and when the heel of the high heel starts to make contact with the ground, the Achilles' tendon is pulled.

Therefore, in the present invention, the Achilles' tendon is repetitively pulled and contracted, whereas in typical high heels, unlike sneakers, the forefoot makes contact with the ground almost simultaneously when the heel makes contact with the ground and the forefoot of the sole is bent, so the Achilles' tendon does not repetitively pull or contract so a contracted state is maintained for a long period of time.

In addition, a buffer element 3 is provided on a forefoot part of the high heel, and while walking, buffering by the buffer element 3 is possible after the foot is landed on the ground such that the arching part may pull and contract, while the back end of the arching part is supported by the protrusion part 1 when the high heel is worn, thereby preventing the weight of a wearer from being concentrated to the front.

FIG. 5 is another view showing an embodiment of the present invention, in which the inclined surface includes a curved surface 2*b* curved downward.

In other words, as shown in FIG. 2, in the case of the inclined surface including the curved surface 2*a* curved upward, the high heel may be easily worn by a person having a foot shaped close to a flat foot, and in the case of the inclined surface including the curved surface 2*b* curved downward, the high heel may be easily worn by a person having a foot shaped close to an elaw foot.

In addition, when a total length of the high heel is 100%, the protrusion part 1 protruding to be positioned on the back end of the arching part of the sole, protrudes from a point of 65% of the total length of the high heel, and the inclined surface 2*a*, which is curved upward, and the inclined surface 2*b*, which is curved downward, extend from a part corresponding to 35% of the total length.

In addition, an inclination angle from the protrusion part 1 to an end of the inclined surfaces 2*a* and 2*b* is maintained in a range of 10° to 15°.

Therefore, when a person starts to walk, the Achilles' tendon may be maximally pulled while a sense of beauty of the high heel is satisfied.

In addition, the buffer element provided at a forefoot part of the high heel extends to a back end of the toe such that the high heel is pressed through a shearing force applied after landing on the floor by the heel of the high heel.

A range of the position of the buffer element 3 is to the back end of the toe.

Therefore, since the shearing force is applied by the buffer element 3 after the heel of the high heel is landed on the ground when the high heel is pressed, when a person normally walks wearing the high heel, the contracted state of the Achilles' tendon and the arching part of the sole is not maintained but the pull and the contraction are repeated.

In addition, even when landing on the ground to start walking, the back end of the arch of the sole is latched by the protrusion part 1 such that the weight is prevented from being concentrated to the front, and the Achilles' tendon is pulled by the curved surface 2*a* in which the heel is curved upward or the curved surface 2*b* in which the heel is curved downward.

In addition, even when the shearing force is applied to the high heel, the protrusion part 1 presses the back end of the arch of the sole so the arch of the sole is repetitively pressed in each step such that the pressure concentrating to the toe is dispersed and the arch of the sole is pressed.

What is claimed is:

1. A high heel shoe for exercising an Achilles' tendon while walking, the high heel shoe comprising:

a part (a) configured to support a toe positioned at a front end of a sole of a foot as the toe is bent to a joint part with the sole at an angle;

a part (b) extending from a posterior portion of the part (a) and configured to support an arching part of the sole of the foot;

a part (c) extending rearward from a posterior portion of the part (b) and configured to closely make contact with a heel of the sole of the foot;

a curved protrusion part, integral to a heel portion of the high heel shoe, extending forward from an anterior portion of the heel portion along a curve of the posterior portion of the part (b) to a transition portion of an inclined surface, the heel portion of the high heel shoe, including the curved protrusion part, being joined to a vertically aligned heel of the high heel shoe;

a buffer element provided externally at a forefoot portion of the high heel shoe, the forefoot portion being within a front half of an overall length of the high heel shoe, the buffer element comprising a plurality of hollow, cylindrical pieces integral to the outsole of the part (a), the plurality of hollow, cylindrical pieces arranged perpendicular to a longitudinal axis of the high heel shoe and configured to extend to a back end of the toe; and the inclined surface having an upward inclination from the posterior portion of the part (a) through to an anterior portion of the part (c) and a downward inclination from the anterior portion of the part (c) to a posterior portion of part (c), the inclined surface being configured to position the heel of the sole of the foot directly above the heel portion of the high heel shoe, wherein an anterior most edge of the curved protrusion part is oriented below and proximate to the transition portion of the inclined surface at which the upward inclination of the inclined surface transitions to the downward inclination of the inclined surface, wherein, the curved protrusion part is adapted to be positioned at the back end of the arching part of the sole of the foot, extending from the anterior portion of the heel portion to a position of 65% of the overall length of the high heel shoe, the 65% of the overall length of the high heel shoe being measured from an anterior edge of the part (a), and wherein a posterior 35% of the overall length comprises a posterior portion of the inclined surface, which is curved upward and a portion of the inclined surface, which is curved downward, terminating at a posterior edge of the part (c).

2. The high heel shoe of claim 1, wherein an inclination angle of an upper surface of the curved protrusion part to a posterior portion of the heel, which is aligned with a posterior portion of part (c), is maintained in a range of 10° to 15°.

* * * * *